US012551773B1

(12) United States Patent
Crawford

(10) Patent No.: US 12,551,773 B1
(45) Date of Patent: Feb. 17, 2026

(54) BOXING GLOVE

(71) Applicant: Jefferey Crawford, Huntington Beach, CA (US)

(72) Inventor: Jefferey Crawford, Huntington Beach, CA (US)

( * ) Notice: Subject to any disclaimer, the term of this patent is extended or adjusted under 35 U.S.C. 154(b) by 0 days.

(21) Appl. No.: 18/949,352

(22) Filed: Nov. 15, 2024

(51) Int. Cl.
*A63B 71/14* (2006.01)

(52) U.S. Cl.
CPC ..... *A63B 71/145* (2013.01)

(58) Field of Classification Search
CPC ..... A63B 71/145; A41D 19/01523
See application file for complete search history.

(56) References Cited

U.S. PATENT DOCUMENTS 1,534,906 A * 4/1925 Bridgewater ..... A63B 71/145 2/18
2,284,300 A * 5/1942 Portal ..... A63B 71/145 2/18
2,416,444 A * 2/1947 Hilton ..... A63B 71/145 2/18
3,540,059 A * 11/1970 Kennedy ..... A63B 71/145 2/18
4,424,595 A * 1/1984 Albert ..... A63B 71/145 2/18
4,457,023 A * 7/1984 Easterday ..... A63B 71/145 2/161.1
4,723,324 A * 2/1988 Lassiter ..... A41D 19/01547 2/163
6,178,553 B1 * 1/2001 Bolton ..... A63B 71/145 2/18
2008/0282439 A1 * 11/2008 Sarkies ..... A41D 19/01 2/163
2014/0359916 A1 * 12/2014 Baunach ..... A41D 19/0013 2/163
2016/0051883 A1 * 2/2016 Clement ..... A63B 71/145 2/161.1

FOREIGN PATENT DOCUMENTS

DE 338348 C * 6/1921 ..... A63B 71/145

OTHER PUBLICATIONS

English translation of DE 338348 obtained via espacenet.com (last visited Jun. 9, 2025). (Year: 2025).*

* cited by examiner

*Primary Examiner* — Patrick J. Lynch
(74) *Attorney, Agent, or Firm* — Craig McLaughlin, AddyHart LLC

(57) ABSTRACT

The invention discloses an improved boxing glove that positions the thumb away from the striking surface of the glove and moves it to a more natural first position across the front of at least a portion of the middle phalanx of the index finger.

2 Claims, 6 Drawing Sheets

BOXING GLOVE

FEDERALLY SPONSORED RESEARCH

Not applicable

SEQUENCE LISTING OR PROGRAM

Not applicable

BACKGROUND OF THE INVENTION

Field of Invention

This invention relates to an improved boxing glove that positions the thumb across at least a portion of the middle phalanx of the index finger to better approximate a natural first position.

Prior Art

Boxing is one of the earliest contact sports. Dating back millennia, bare fists were initially used in the sport and still are in certain contests. Means to protect a boxer's hands have had a long history too.

Before boxing gloves were available, Homer's *Illiad* recalls use of ox hide strips to wrap and protect a fighter's hands during the engagement. Such strips were used to wrap over knuckles and wrists in the Olympic Games in 668 BC.

The development of boxing gloves has also had a long and varied history and has evolved into use of leather covering and internal padding consisting of a variety of materials. Padded gloves were introduced in the late 1700's and were mandated in 1865 by Marquess of Queensbury Rules that originated in London. Cotton and horsehair were generally used for padding until the adoption of foam in the $20^{th}$ century.

A boxing glove today includes a curved compartment to accept insertion of the four fingers of each hand and a separate compartment for insertion of the opposing thumb, all covered by substantial foam padding on the back of the hand and thumb portions and encased by a soft flexible leather covering formed and stitched together to form the glove. Laces are added to the underside of the wrist to allow the hand to be inserted into the glove then tightened for securement and use, and removed as desired. The foam padding and soft leather covering help to protect a boxer's hands during engagement with the target and to inhibit damage to the target from a landed strike.

Unlike a bare first formation, the thumb of a prior art boxing glove is positioned adjacent the lateral side of the proximal phalanx of the index finger. The extensive padding of the finger portion blocks the thumb from forming a traditional fist. The position of the thumb of prior art gloves has several disadvantages. For example, the tip of the padded thumb may protrude from the front of the glove and undesirably interfere in strikes to the target resulting in thumb damage, thumb-poking eye injuries to an opponent, and compromising striking performance. The padded finger portion of prior art gloves prevents the thumb from bending more acutely to form a more natural and powerful striking fist.

Objects and Advantages

One object of the instant invention is to provide a boxing glove that repositions the thumb to bend more acutely and lie across the front of at least a portion of the middle phalanx of the index finger to better approximate the formation of a traditional fist. This position allows for direct punches with the padded clenched and aligned proximal phalanxes of the fingers without interference from a protruding thumb.

Another object of the invention is to provide a boxing glove that stabilizes the thumb and positions it in a more comfortable and natural position to improve striking force and reduce thumb and eye injury.

SUMMARY OF THE INVENTION

The invention discloses an improved boxing glove that positions the thumb away from the striking surface of the glove and moves it to a more natural first position across the front of at least a portion of the middle phalanx of the index finger.

DETAILED DESCRIPTION OF PREFERRED EMBODIMENTS

Figure 1:
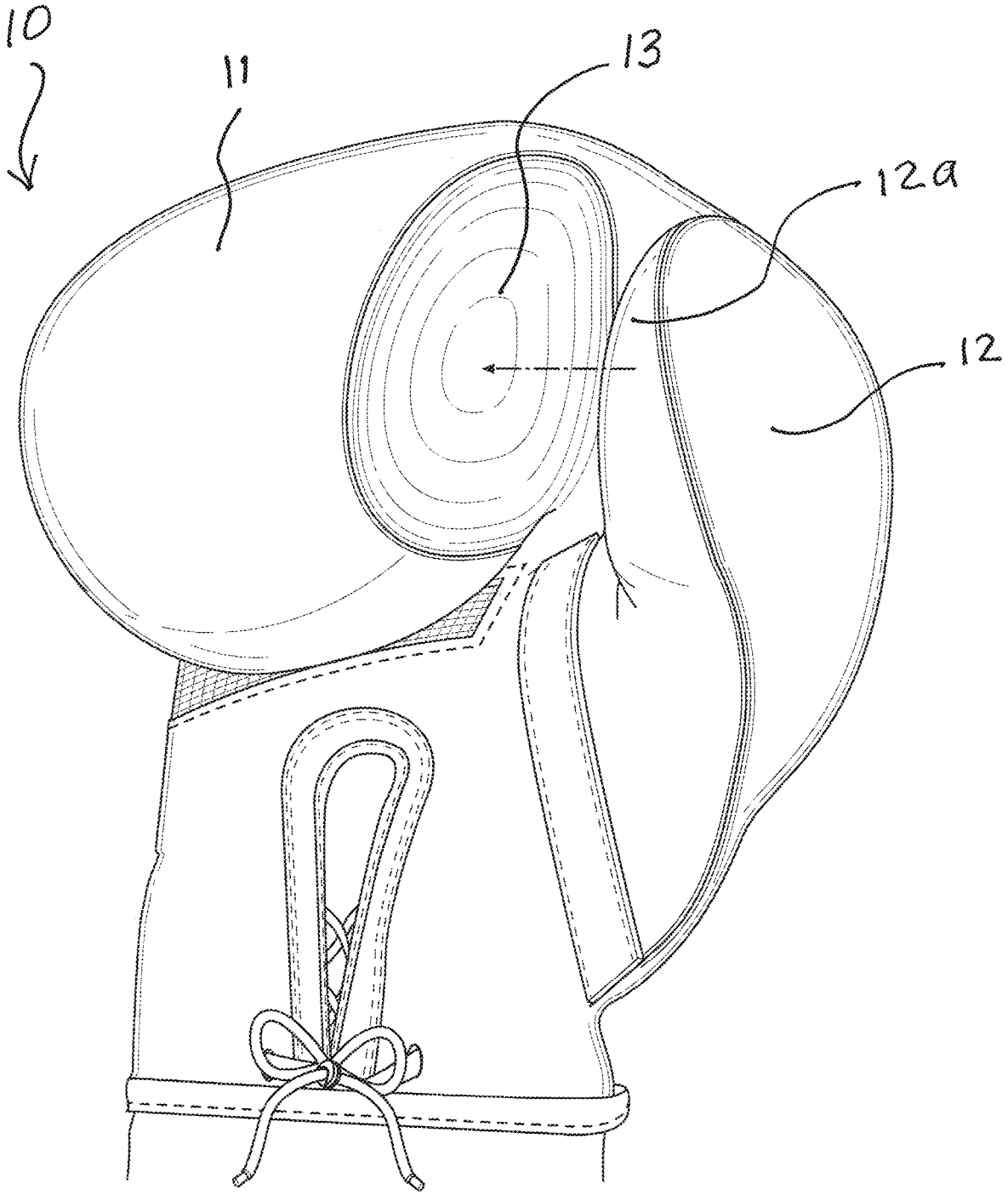
FIG. 1 is a perspective view of a preferred embodiment of the present boxing glove invention showing a thumb seat cavity in the padded finger portion of the glove.

FIG. 1 illustrates a perspective view of a preferred embodiment of the present boxing glove invention 10 showing a padded finger portion 11, a padded thumb portion 12 having a thumb tip 12*a*, and thumb seat cavity 13 formed into the padded finger portion. The padded thumb portion 12 is provided to accommodate the bend of an inserted thumb to approximate a naturally formed ungloved first where the thumb is bent over to cross the front of at least a portion the middle phalanx of the index finger.

Figure 2:
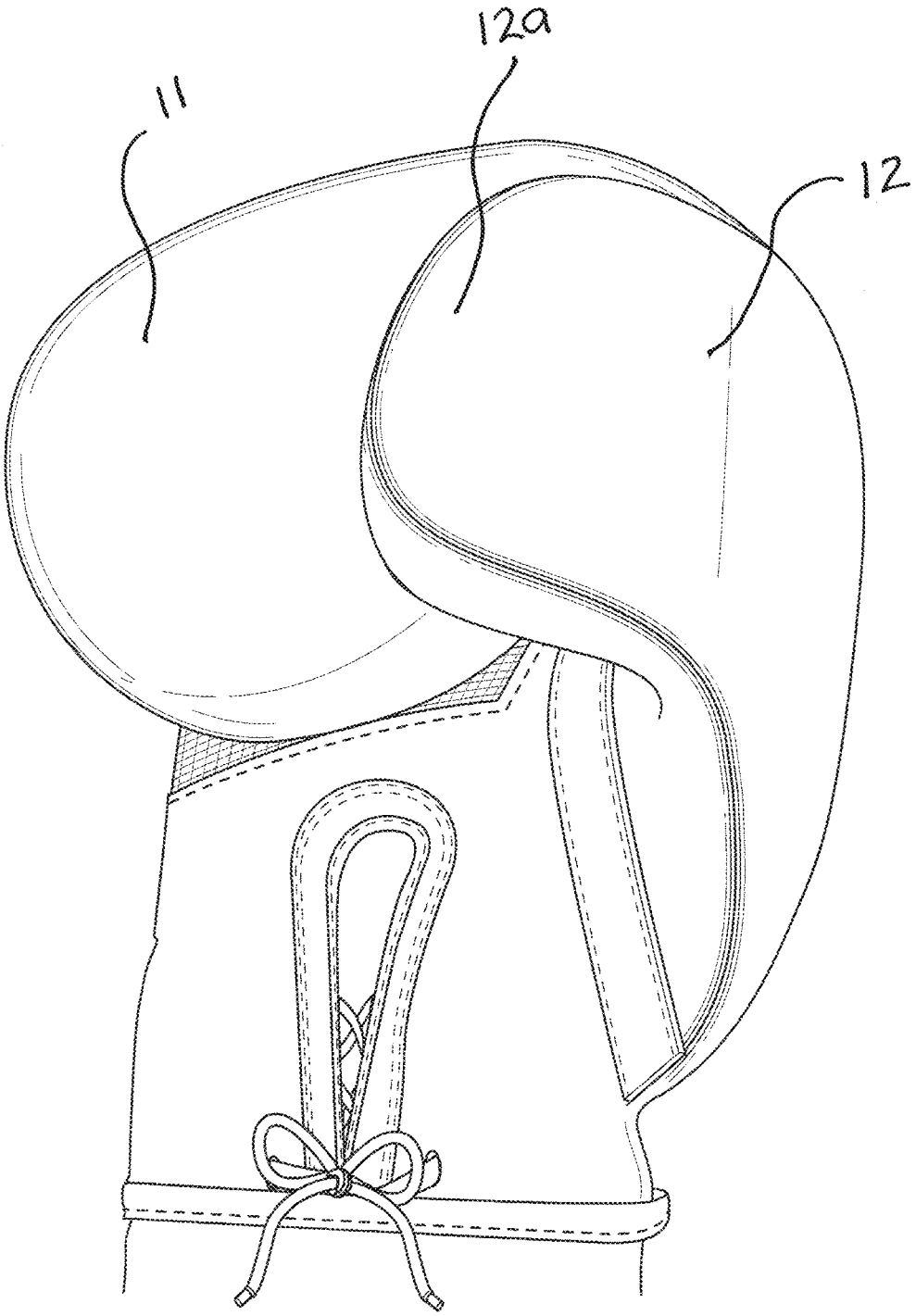
FIG. 2 is a perspective view of a preferred embodiment of the present boxing glove invention showing the padded thumb tip nested into the thumb seat cavity.

FIG. 2 illustrates a perspective view of a preferred embodiment of the present boxing glove invention showing the padded thumb tip 12*a* nested into the formed thumb seat cavity (not shown) of the padded finger portion 11.

Figure 3:
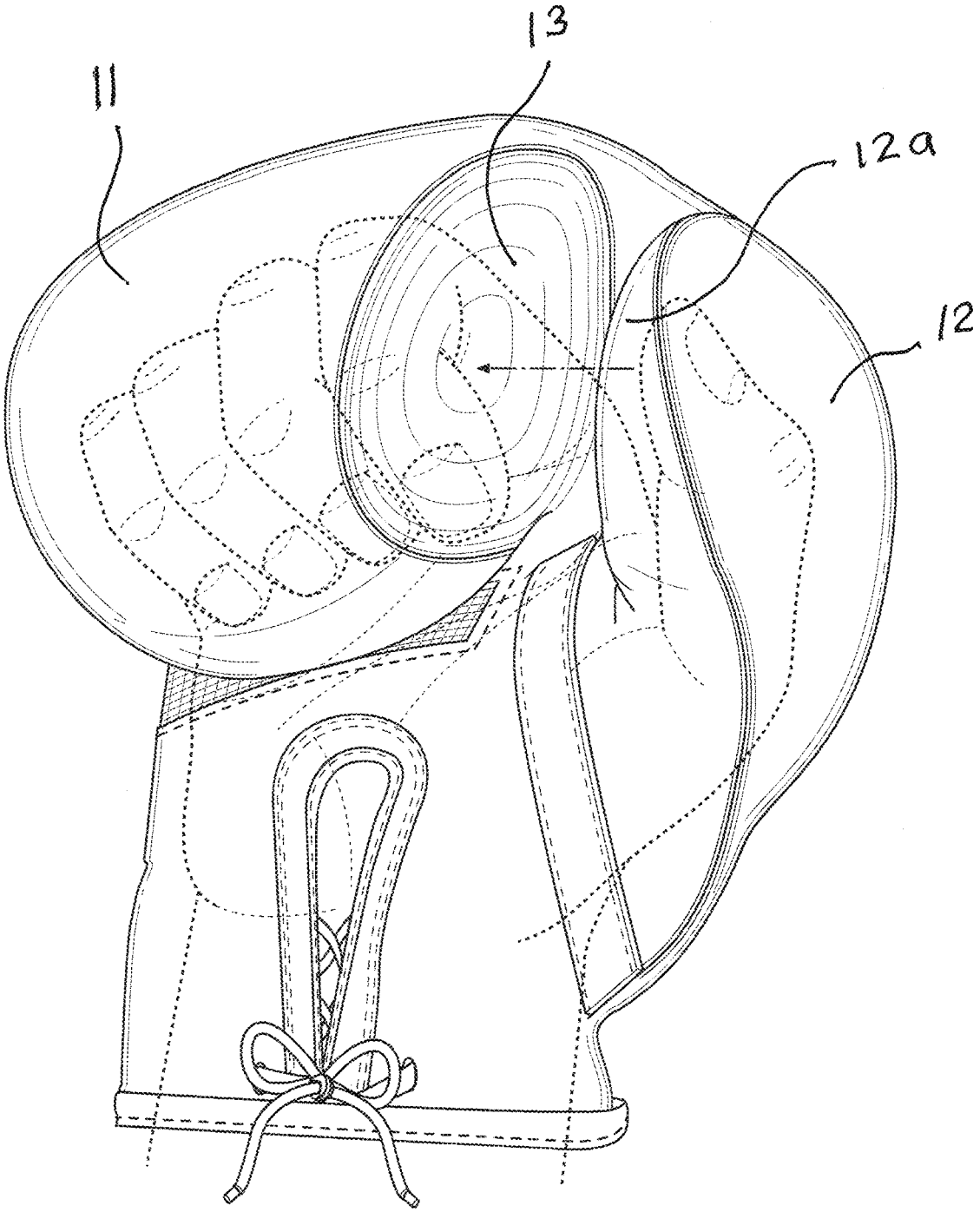
FIG. 3 is a perspective view of a preferred embodiment of the present boxing glove invention showing a thumb seat cavity in the padded finger portion of the glove and the position of the hand inside the glove.

FIG. 3 illustrates a perspective view of a preferred embodiment of the present boxing glove invention showing a padded finger portion 11, a padded thumb portion 12 having a thumb tip 12*a*, and a thumb seat cavity 13 formed into the padded finger portion. Although not part of the invention, included in this figure is an inserted hand to depict the relationship of the hand inside the glove.

Figure 4:
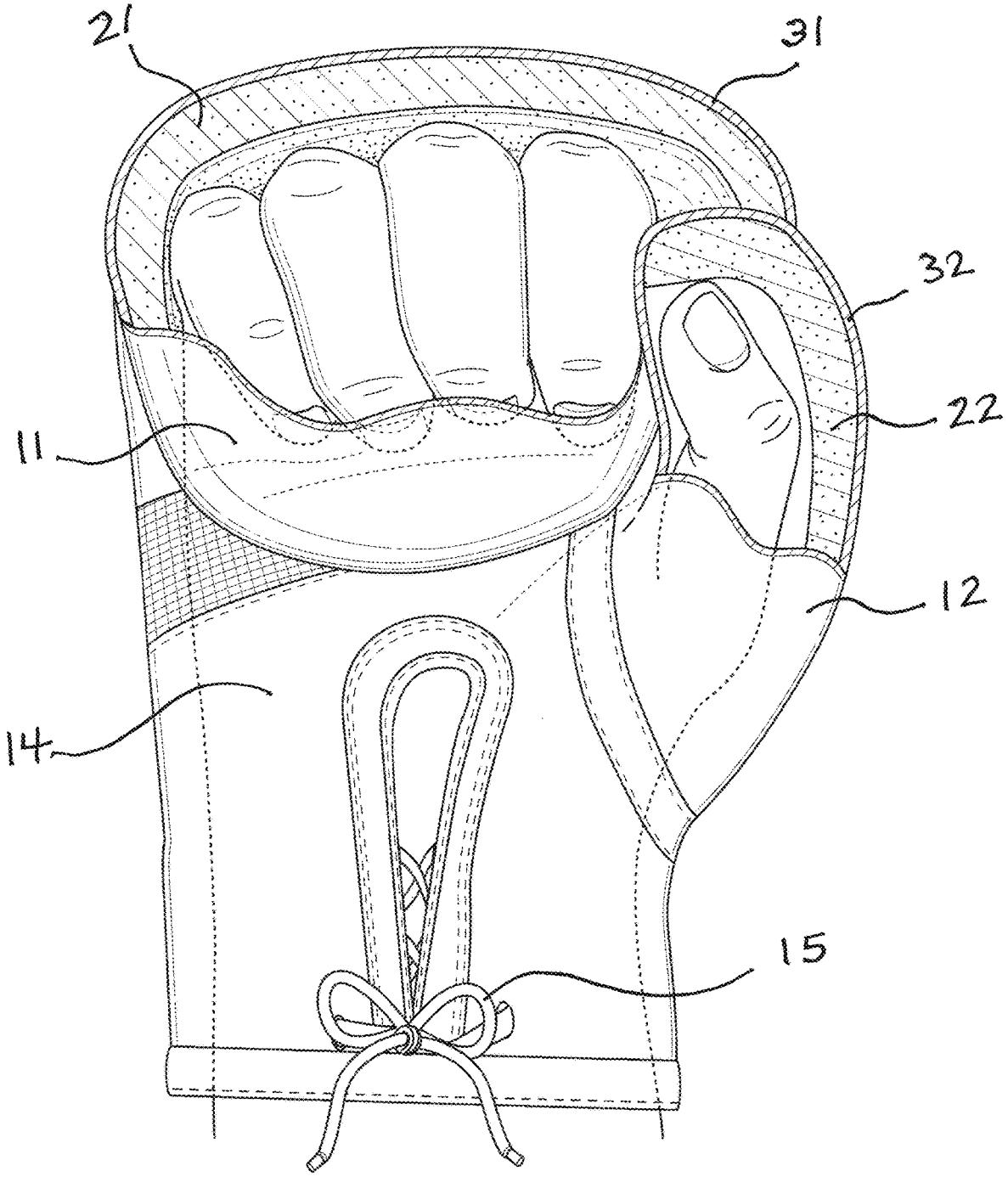
FIG. 4 is a sectional view of a preferred embodiment of the present boxing glove invention showing the padding of the finger and thumb portions of the glove.

FIG. 4 illustrates a sectional view of a preferred embodiment of the present boxing glove invention showing a padded finger portion 11, a padded thumb portion 12, finger padding 21, thumb padding 22, finger portion leather cover 31, and thumb portion leather cover 32. The glove also includes a palm side 14, of which there is little if any padding, and a set of laces 15 to secure the glove to the hand.

Producing the instant invention can be readily understood by a maker of ordinary skill in the boxing glove fabrication art by modifying the traditional glove-making process to include the cavity in the finger padding, a more acutely bent thumb portion, and cutting and stitching the surrounding leather covering to accommodate them. The desired cavity can be fashioned from removing a portion of the traditional foam finger padding or by way of a padding mold that produces the cavity. Assembly of the glove can be accomplished by inserting the pre-formed foam padding of the finger portion and the thumb portion into the flexible leather covering as is typically done in the art.

In an optional embodiment (not shown), a permanent cavity need not be created. Instead, lower density padding can be utilized in that particular location of the padded finger portion so that a similar first can be made by pressing the thumb tip into it and compressing the padding sufficiently to form a temporary cavity to achieve similar results.

Figure 5:
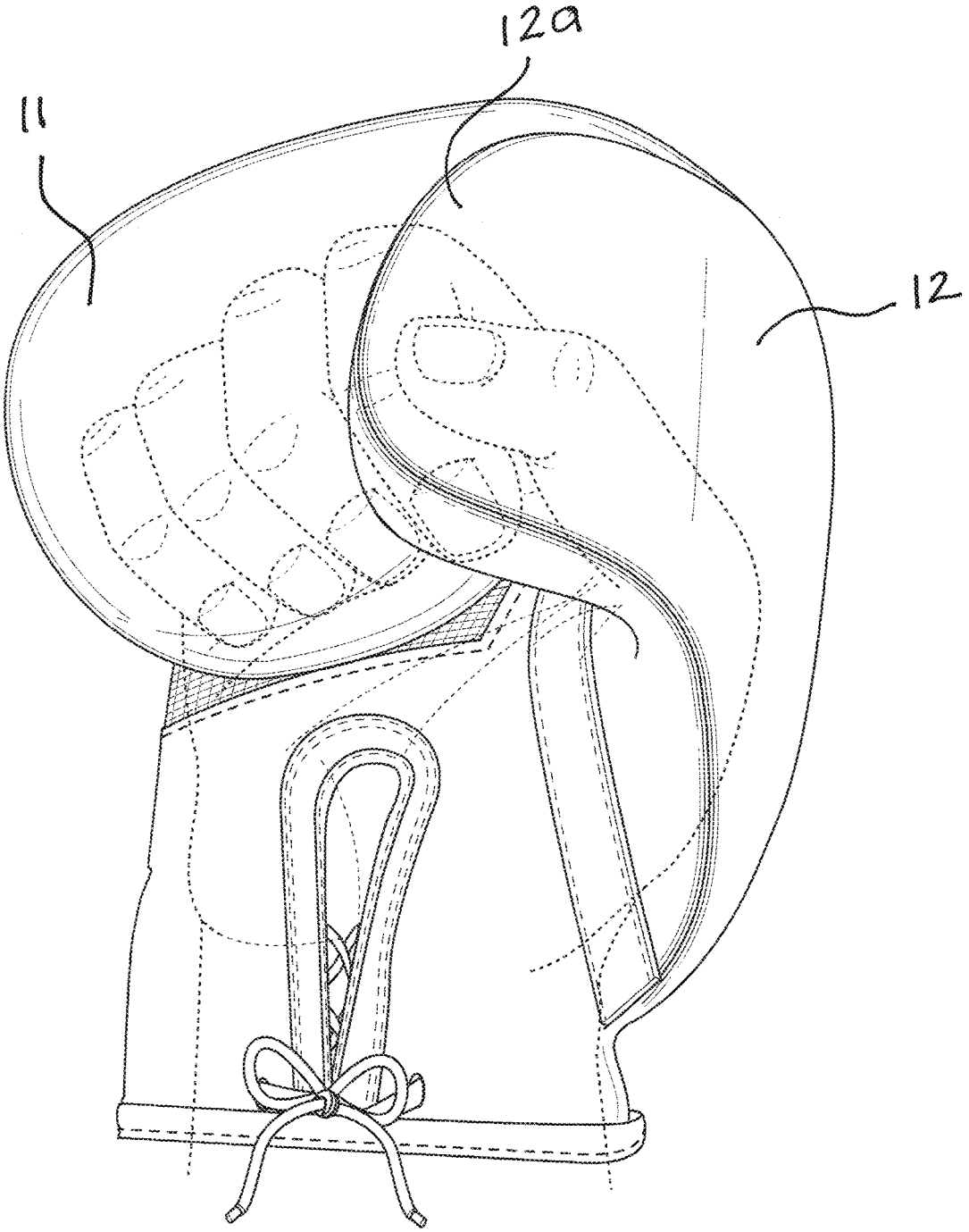
FIG. 5 is a perspective view of a preferred embodiment of the present boxing glove invention showing the padded thumb tip nested into the thumb seat cavity and the thumb shown positioned across the middle phalanx of at least a portion of the index finger.

FIG. 5 illustrates a perspective view of a preferred embodiment of the present boxing glove invention showing a padded finger portion 11, a padded thumb portion 12 having a tip 12*a* nested into the thumb seat cavity (cavity not shown). Although not part of the invention, included in this figure is an inserted hand to depict the relationship of the hand inside the glove, a portion of the thumb crossing in front of the middle and distal phalanx of the index finger, more closely approximating the formation of a traditional fist. Optionally, the padded thumb portion may be fashioned to cross the middle phalanx of one or more fingers to form a tighter fist.

Figure 6:
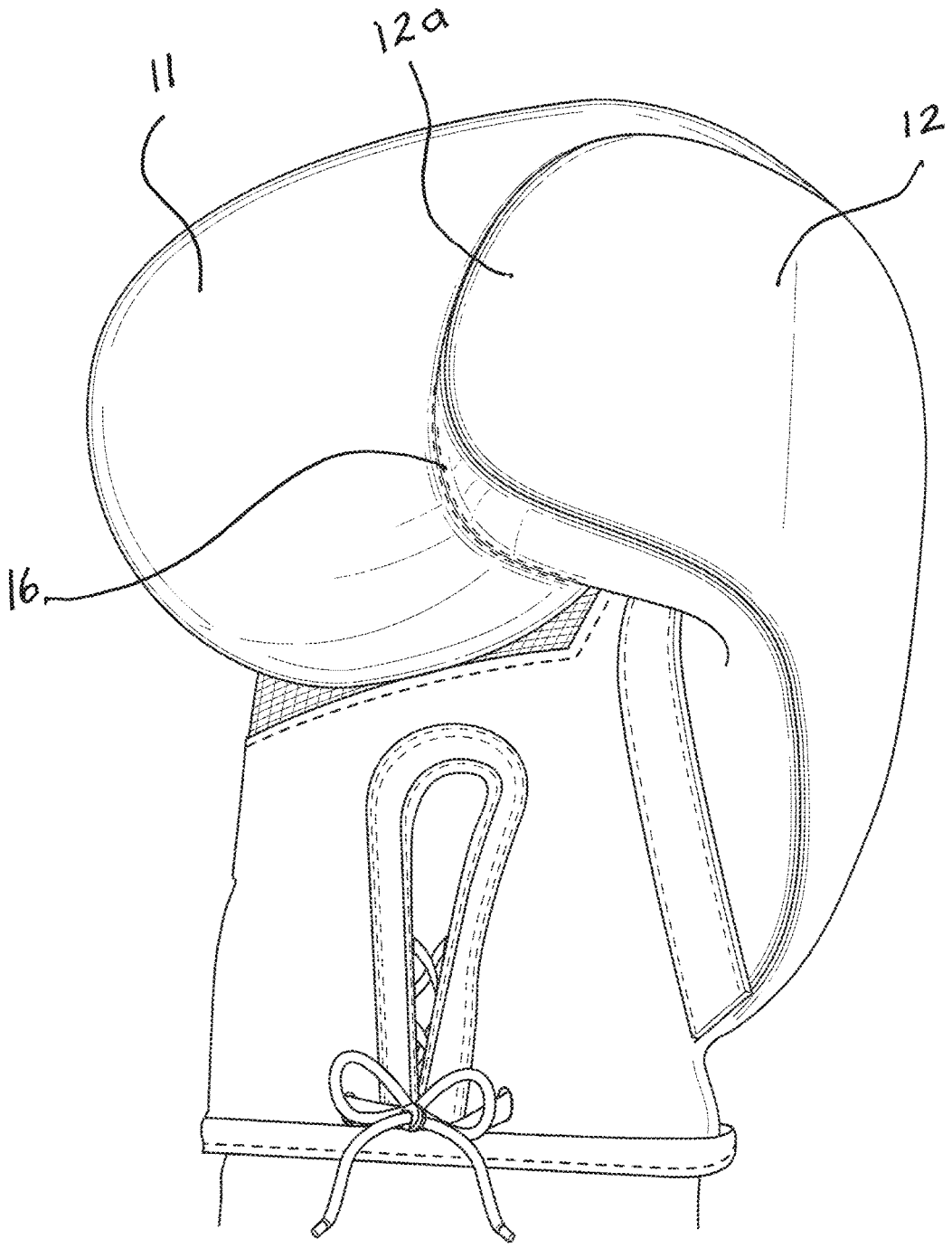
FIG. 6 is a perspective view of a preferred embodiment of the present boxing glove invention showing the padded thumb tip nested into the thumb seat cavity and sewn to the padded finger portion.

FIG. 6 is a perspective view of a preferred embodiment of the present boxing glove invention showing a padded finger portion 11, a padded thumb portion 12 having a tip 12*a*, the tip nested into the thumb seat cavity (cavity occupied and not shown) of the padded finger portion 11. The tip of the padded thumb portion is affixed to the padded finger portion by stitching 16. Optionally, the padded finger portion and padded thumb portion could be joined together to provide communication between the thumb and index finger without a covering barrier. This can be accomplished by opening the tip and opening a corresponding hole in the padded finger portion (not shown) to join the portions together at that location, via stitching or otherwise.

As one can see from the drawings and the descriptions above, the present invention substantially advances the art of boxing gloves. Although the description above contains many details and specificities, these should not be construed as limiting the scope of the invention, but as provision of examples of some of the presently preferred embodiments of the invention. The scope of the invention should be determined by the appended claims and their legal equivalents, rather than by the examples provided.

I claim:

1. An improved boxing glove comprising: a padded finger portion having a cover material and configured to accept insertion of all four fingers, including the index finger, a padded thumb portion having a cover material and including a tip configured to accept insertion of a thumb, wherein the padded finger portion is configured to accept receipt of at least the tip of the padded thumb portion so that at least a part of the thumb can be positioned across at least a portion of the front of the middle phalanx of the index finger, wherein the padded finger portion includes a cavity to receive the tip, and wherein the cavity is formed by compression of the tip into a corresponding location in the padded finger portion that contains padding of a lower density than other padding in the finger portion.

2. A method to produce an improved boxing glove comprising: creating a padded finger portion having a cover material configured to accept insertion of all four fingers, including the index finger, creating a padded thumb portion having a cover material and including a tip configured to accept insertion of a thumb, creating the padded finger portion to accept receipt of at least the tip of the padded thumb portion so that at least a part of the thumb can be positioned across at least a portion of the front of the middle phalanx of the index finger, creating a cavity in the padded finger portion to receive the tip, and creating the padded finger portion to include padding of lower density than other padding in the finger portion in a location to allow application of pressure on the tip to compress that location to form the cavity.

* * * * *